US010317077B2

(12) United States Patent
Hansen et al.

(10) Patent No.: US 10,317,077 B2
(45) **Date of Patent: *Jun. 11, 2019**

(54) TORCH WITH SPRING LOADED SNUFFER

(71) Applicant: Lamplight Farms Incorporated, Menomonee Falls, WI (US)

(72) Inventors: Lars Hansen, Holstebro (DK); David A. Reed, Hartford, WI (US); Ron White, North Prairie, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/892,165

(22) Filed: Feb. 8, 2018

(65) Prior Publication Data

US 2018/0163963 A1 Jun. 14, 2018

Related U.S. Application Data

(63) Continuation of application No. 14/707,939, filed on May 8, 2015, now Pat. No. 9,920,931.

(51) Int. Cl.

| | |
|---|---|
| ***F21V 37/00*** | (2006.01) |
| ***F23Q 25/00*** | (2006.01) |
| ***F23D 3/26*** | (2006.01) |

(52) U.S. Cl.

CPC ..... *F23Q 25/00* (2013.01); *F21V 37/0008* (2013.01); *F23D 3/26* (2013.01); *F21V 37/002* (2013.01)

(58) Field of Classification Search

CPC ..... F21V 37/002
USPC ..... 431/289
See application file for complete search history.

(56) References Cited

U.S. PATENT DOCUMENTS

| | | | |
|---|---|---|---|
| 412,969 | A | 10/1889 | Miller |
| 481,268 | A | 8/1892 | Price |
| 3,169,519 | A | 2/1965 | Aizawa et al. |
| 3,236,072 | A | 2/1966 | Goldszmid |
| 6,159,002 | A | 12/2000 | LeJeune |
| 6,960,320 | B1 | 11/2005 | Smith et al. |
| D679,048 | S | 3/2013 | White |
| 8,439,669 | B2 | 5/2013 | Masterson et al. |
| 2001/0053504 | A1 | 12/2001 | Lu |
| 2007/0072140 | A1 | 3/2007 | Almodovar |

(Continued)

FOREIGN PATENT DOCUMENTS

| | | |
|---|---|---|
| DE | 4304970 | 10/2016 |
| JP | 58158427 | 9/1983 |
| WO | WO2010040155 A2 | 4/2010 |

OTHER PUBLICATIONS

EP 16 16 8120, European Search Report, published Oct. 10, 2016, Applicant: Lamplight Farms Incorporated.

*Primary Examiner* — Avinash A Savani
(74) *Attorney, Agent, or Firm* — David G. Woodral; GableGotwals

(57) ABSTRACT

A device has a canister for attaching to a fuel container with a wick holder passing through the canister for holding a wick in a position to draw fuel from the reservoir for combustion proximate the top cap. A snuffer in the canister has a sleeve extendible from a first retracted position to a second extended position, the second extended position extending the sleeve partially beyond the wick holder. When the canister is upright the snuffer remains in the first lowered position and when the canister is tilted beyond a predetermined angle the spring moves the sleeve to the second extended position.

19 Claims, 4 Drawing Sheets

(56) References Cited

U.S. PATENT DOCUMENTS

| | | | |
|---|---|---|---|
| 2007/0218413 | A1 | 9/2007 | Heng-Wei |
| 2009/0068608 | A1 | 3/2009 | Hansen |
| 2010/0112504 | A1 | 5/2010 | Reed |
| 2013/0027918 | A1 | 1/2013 | White |
| 2013/0323659 | A1 | 12/2013 | White |
| 2015/0167966 | A1 | 6/2015 | Hansen |

TORCH WITH SPRING LOADED SNUFFER

CROSS-REFERENCE TO RELATED CASES

This application is a continuation of U.S. patent application Ser. No. 14/707,939 entitled TORCH WITH SPRING LOADED SNUFFER, filed May 8, 2015, the contents of which are hereby incorporated by reference.

FIELD OF THE INVENTION

This disclosure relates to liquid fueled torches in general and, more particularly, to a liquid fueled torch with enhanced safety features.

BACKGROUND OF THE INVENTION

Liquid fueled torches are utilized for a number of purposes such as lighting, decoration, and pest repellence. Users should seek to quickly extinguishing any burning torch that overturns or otherwise becomes unstable.

What is needed is a system and method for addressing the above, and related, issues.

SUMMARY OF THE INVENTION

The invention of the present disclosure, in one aspect thereof, comprises a device having a canister for attaching to a fuel container with a wick holder passing through the canister for holding a wick in a position to draw fuel from the reservoir for combustion proximate the top cap. A snuffer in the canister has a sleeve extendible from a first retracted position to a second extended position, the second extended position extending the sleeve partially beyond the wick holder. A spring biases the snuffer sleeve toward the second raised position. When the canister is upright the snuffer remains in the first lowered position and when the canister is tilted beyond a predetermined angle the spring moves the sleeve to the second extended position.

The snuffer may further comprise a flange affixed to a proximal portion of the sleeve. The flange receives the biasing force of the spring. The spring may comprise a coil spring pressing upward on the flange at least when the canister is upright. The coil spring may circumscribe the wick holder. Some embodiments include a free weight in the canister that bears down upon the flange when the canister is upright. The free weight may comprise a metallic ball that is unrestrained within the canister.

The device may include a top cap affixed to the canister and having an aperture proximate a distal end of the wick holder and sized to allow the snuffer sleeve to extend from the first retracted position to the second extended position by sliding beyond the upper end of the wick holder. Some embodiments include a snuffer cap affixed in a stationary relationship with respect to the top cap and placed beyond the distal end of the wick holder such that the snuffer sleeve contacts the snuffer cap in the second extended position to enclose a portion of the wick extending beyond the wick holder.

In various embodiments, a fitting is included to affix the canister to a liquid fuel container. The wick holder may extend through the fitting. In some embodiments the canister, the snuffer sleeve, and the wick holder share a common central axis.

The invention of the present disclosure, in another aspect thereof comprises a torch having a wick holder with a combustion end and a fuel reservoir end. The torch has a snuffer sleeve in a sliding engagement surrounding the wick holder and having a retracted position and an extended position wherein the snuffer sleeve extends beyond the combustion end of the wick holder. A biasing member urges the snuffer sleeve toward the extended position. The weight of the snuffer sleeve and the force of the biasing member are such that the snuffer sleeve remains in the retracted position when the torch is upright. The snuffer sleeve extends to the extended position in response to an impact between the torch and a torch supporting surface when the snuffer sleeve is deviated from a vertical position more than a predetermined amount. The vertical position is defined by a position of the snuffer sleeve wherein the combustion end is fully superior to the fuel reservoir end.

In some embodiments the wick holder passes coaxially through a canister that retains the snuffer sleeve position inside the canister when in the retracted position. The canister may have a top cap with a central opening sized to pass the snuffer sleeve but retain within the canister a flange affixed to the sleeve. The biasing member may be a coil spring that surrounds the wick holder and engages against the flange to urge the snuffer sleeve toward the extended position. The torch may have a stationary snuffer cap spaced apart a fixed distance from the combustion end of the wick holder such that the snuffer sleeve contacts the snuffer cap when the snuffer sleeve is in the extended position.

The invention of the present disclosure, in another aspect thereof, comprises a device having a canister defining an interior volume between a fuel container fitting and a top cap, a wick holder passing through the interior volume, and a snuffer sleeve slidingly engaged with the wick holder between. A flange extends from the snuffer sleeve inside the interior volume, the flange being retained within the interior volume by the top cap. A spring is within the interior volume on an opposite side of the flange from the top cap. The snuffer sleeve has an extended position that places the snuffer sleeve at least partially off the wick holder and out of the interior volume. The snuffer has a retracted position wherein the flange compresses the spring in the interior volume. The snuffer is retained in the retracted position when the canister is upright and the snuffer is moved by the spring to the extended position when the canister is tipped to one side.

The device may further comprise a free weight interposing the flange and the top cap. The spring may be a coil spring circumscribing the wick holder. Some embodiments include a snuffer cap affixed to the top cap such that the snuffer sleeve contacts the snuffer cap when in the extended position but not when in the retracted position.

DETAILED DESCRIPTION OF THE PREFERRED EMBODIMENTS

Figure 1:
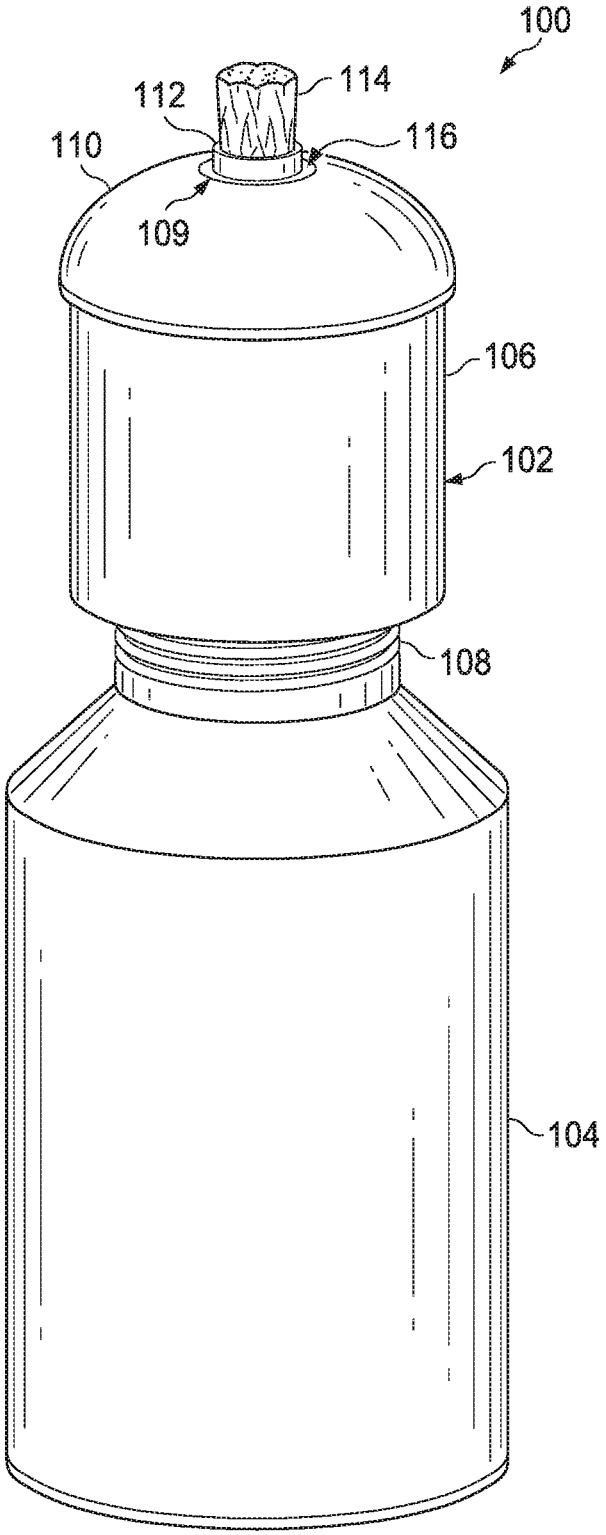
FIG. 1 is perspective view of a liquid fueled torch with a spring loaded snuffer according to aspects of the present disclosure.

Referring now to FIG. 1, a perspective view of a liquid fueled torch 100 with a spring loaded snuffer 116 according to aspects of the present disclosure is shown. The torch 100 comprises a burner 102 affixed to a fuel reservoir 104. The burner 102 includes a canister 106 with a fitting 108 allowing the burner 102 to be connected to the reservoir 104. In some embodiments, the fitting 108 is a threaded fitting such that the burner 102 can be removed from the reservoir 104, allowing selective access into the reservoir 104 for refueling and the like.

The reservoir 104 and the burner 102 may comprise metals or metal alloys. The materials of construction should be suitably resilient against heat, and corrosion so as to provide a useful service life for the components. In some embodiments, all or part of the burner 102 and/or reservoir 104 may be painted or otherwise coated with a heat and/or corrosion resistant material.

The burner 102 may also include a top cap 110 affixed to the canister 106. The cap 110 includes an aperture 109, which may be defined near an upper domed surface of the cap 110. The aperture 109 provides for passage of a wick holder 112 and a wick 114. In some embodiments, the wick holder 112 retains the wick 114 in a friction fit relationship. The wick 114 may be a woven fiberglass wick designed to last for an extended length of time.

As will be described in greater detail below, a snuffer 116 is at least partially extendable through the aperture 109 to selectively surround the exposed portion of the wick 114. Any flame or combustion occurring on the wick 114 is thereby extinguished by oxygen starvation.

Figure 2:
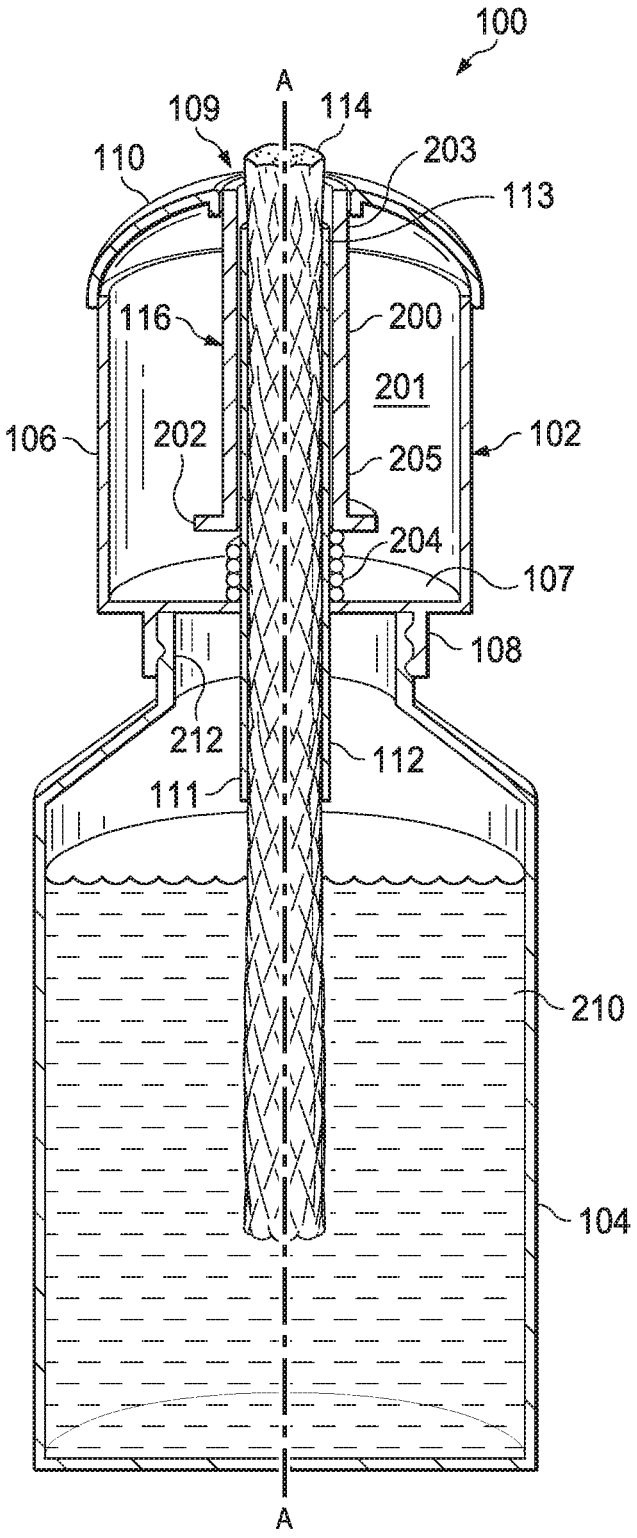
FIG. 2 is a perspective cutaway view of the torch of FIG. 1.

Referring now to FIG. 2, a perspective cutaway view of the torch 100 of FIG. 1 is shown. Here, it can be seen that the canister 106 defines an interior volume 201 that may be said to be bounded by the canister wall 106 as well as the top cap 110 and a canister floor 107.

The wick holder 112 can be seen to pass through the interior volume 201 of the canister 106 and spanning from a distal end 113, proximate the aperture 109, down to a proximal end 111 that may extend through the floor 107 and even partially beyond the fitting 108. The wick holder 112 may be affixed to the floor 107 where it passes therethrough.

Throughout the present disclosure, various components are referred to as having "proximal" or "distal" parts and/or positions. It should be understood that these refer to the relative position of the components to what might be considered a medial portion of the torch 100. Such a medial portion of the torch 100 would be, for example, near the floor 107 and/or fitting 108, or near where the burner 102 and reservoir 104 are joined.

In FIG. 2, the torch 100 is illustrated in an upright position and therefore a distal component would be one that is oriented towards the top of the torch 100 versus a proximal component that would be oriented closer to the lower or middle portion of the torch 100. In each case, as shown in FIG. 2, a distal orientation would be fully superior to the corresponding proximal orientation. The terms "proximal" and "distal" are also used for purposes of clarity when, as below, the torch 100 is described as having been tilted or overturned. In such case, directions such as "up" or "down" might be less descriptive or even incorrect but the terms "proximal" and "distal" will remain the same.

Referring again to FIG. 2, the distal end 113 of the wick holder 112 might also be said to be a combustion end of the wick holder 112. This is because distal end 113 of the wick holder 111 is nearest to where fuel is drawn in by the wick 114 is actually burned or combusted. The proximal end 111 may also be said to be a fuel reservoir end. The proximal end 111 is nearest to the fuel reservoir 104 and, as shown, may even be partially inserted into the reservoir 104. The wick 114 is shown extending from the distal or combustion end 113, down through the wick holder 112, and beyond the fuel reservoir or distal end 113 into a quantity of liquid fuel 210 illustrated in the reservoir 104. As previously described, the level or amount of fuel 210 in the reservoir 104 may be replenished by removing the burner 102 from the reservoir 104.

FIG. 2 illustrates the torch 100 in an upright position. The snuffer 116 comprises a sleeve 200 spanning between a distal end 203 and a proximal portion 205. Affixed to the proximal portion 205 is a flange 202 that may extend laterally from the sleeve 200. The snuffer 116 is illustrated in a retracted or proximal position. The snuffer 116 in this position may compress or rest upon a biasing member or spring 204. In the present embodiment, the spring 204 circumscribes the wick holder 112, as does the snuffer 116. In embodiments where a spring 204 circumscribes the wick holder 112, the flange 202 may only be wide enough to just cover the spring 204. However, in other embodiments, the flange 202 may extend further, even so far as to substantially fill the width of the canister 106.

The spring 204 may be a steel coil spring but could also be an appropriately arranged leaf spring, or other type of spring. A single spring 204 is illustrated here and circumscribes or surrounds the wick holder 112. While having the spring 204 circumscribe the wick holder may confer benefits such as properly locating the spring 204, other embodiments use springs that are detached from the wick holder 112. For example, one or more springs (coil, leaf, or otherwise) could be oriented to act in parallel to the wick holder 112, but not necessary circumscribe the wick holder. Some embodiments provide for two or more parallel springs (not shown) arranged radially about the wick holder 112 to distribute forces to the flange 202 evenly. In further embodiments still, multiple springs may be arranged to circumscribe the wick holder and be stacked atop one another or nested. It will also be appreciated that there could be one or more springs circumscribing the wick holder 112, while one or more additional springs are parallel but not circumscribing.

The snuffer 116 is in a sliding engagement with the wick holder 112. In the viewpoint of FIG. 2, where the torch 100 is upright, the snuffer 116 compresses the spring 204 and remains in the retracted or proximal position. In this position, the distal end 203 of the snuffer sleeve 200 terminates at approximately the same position as the distal end 113 of the wick holder 112. This allows combustion to take place on the exposed portion of the wick 114 unimpeded. The distal end 113 of the wick holder 112 as well as the distal end 203 of the sleeve 200 may both terminate at or slightly below the aperture 109 defined in the cap 110. This provides for maximal exposure of the wick 114 when the torch 100 is in the upright position.

In the illustrated embodiment of FIG. 2, it can be seen that the components comprising the torch 100 are all coaxial about a central axis AA. Further, the reservoir 104 and burner 102, as well interior components of the burner such as the wick holder 114 and snuffer 116 are generally cylindrical. Although such an arrangement may provide ease of manufacture and assembly, the coaxially and cylindrical arrangement are not necessary for all embodiments encompassed by the present disclosure. The shape of the reservoir 104, for example, may conform to the shape of a table top torch holder (not shown) or a bamboo or wicker lawn torch holder (not shown).

Figure 3:
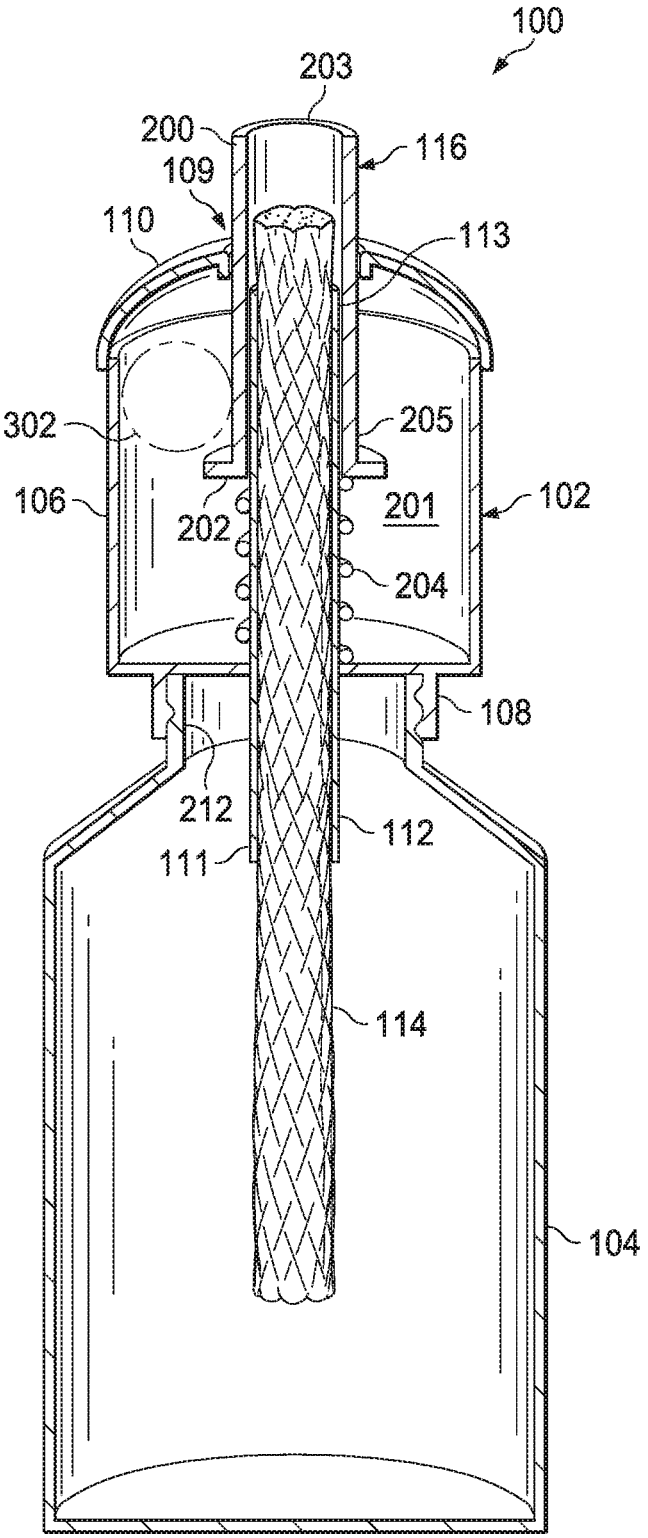
FIG. 3 is a perspective view of the torch of FIG. 1 showing the snuffer in the extended position.

Referring now to FIG. 3, a perspective view of the torch 100 of FIG. 1, showing the snuffer 116 in an extended position, is shown. The appearance of the torch 100 in FIG.

3 may correspond, for example, to the torch 100 having been tipped fully or partially onto its side. In such case, the spring 204 pressing against the flange 202 is able to overcome the weight of the snuffer 116, thereby extending the snuffer into the extended or distal position shown in FIG. 3. As can be seen, in the extended position, the distal end 203 of the sleeve 200 extends beyond the previously exposed portion of the wick 114. In such a configuration, the wick 114 will quickly become starved of oxygen and any flame or combustion on the wick 114 will rapidly come to an end.

The distal end 203 of the sleeve 200 extends beyond the top of the wick 114 sufficiently to starve any flame on the wick 114 of oxygen resulting in the flame being extinguished. In the present embodiment, with the sleeve 200 only marginally larger in diameter than the wick holder 112, the flame will be quickly and reliably extinguished when the distal end 203 of the sleeve 200 extends beyond the top of the wick 114 at least twice as far as the diameter of the wick 114.

The degree to which the torch 100 must tip or tilt in order to deploy the snuffer 116 distally such that any flame is extinguished may vary depending upon a number of factors. One such factor is the strength or spring rate of the spring 204. Another factor is the weight of the snuffer 116. In one embodiment, the spring and weight of the snuffer 116 are configured such that the snuffer 116 extends into the distal position if the torch 100 has tilted more than about 30 degrees.

In some embodiments, maximum extension is not achieved until the torch 100 has tilted by greater than 45 degrees. In further embodiments still, the spring 204 and snuffer 116 may be configured such that maximum distal extension is not achieved until the torch 100 is tilted approximately 90 degrees, which would correspond to the torch 100 having been tipped completely onto its side. Some embodiments perform in use such that maximum distal extension is assured by an approximately 90 degree (or greater) tilt accompanied by an impact that would correspond to the torch 100 having impacted the ground or other supporting surface upon turning over completely.

In some embodiments, to further control or adjust the weight applied to the spring 204 in various positions, an additional weight 302 (shown in phantom) may be provided in the interior volume 201 of the canister 106. The weight 302 may be a free weight, such as a metal sphere or ball bearing that is allowed to move freely within the interior volume 201.

In the present embodiment, the flange 202 is sized such that the weight 302 always remains on the opposite side of the flange 202 from the spring 204. Stated another way, the weight 302 is always between the flange 202 and the top cap 110. Such a configuration may provide additional downward force on the spring 204 when the torch 100 is upright, thereby ensuring that the wick 114 is maximally exposed. If and when the torch 100 begins to tip, the weight 302 will provide less and less force against the spring 204, thereby ensuring that the snuffer 116 and the sleeve 200 reach maximal extension to smother any flame.

The flange 202 may be sized larger in diameter than the aperture 109 such that the snuffer 116 remains captive to the burner 102 and remains at least partially inside the interior volume 201 of the canister 102.

Figure 4:
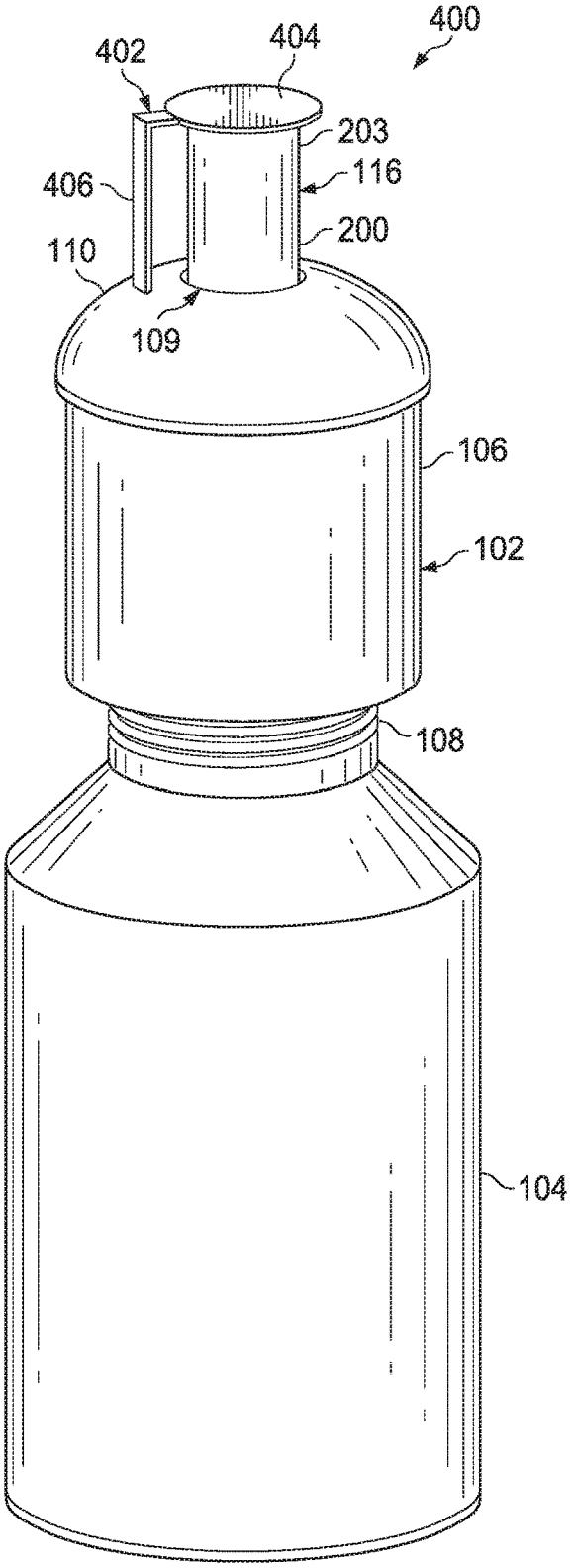
FIG. 4 is a perspective view of another embodiment of a liquid fueled torch with a spring loaded snuffer in the extended position according to aspects of the present disclosure.

Referring now to FIG. 4, a perspective view of another embodiment of a liquid fueled torch 400 with a spring loaded snuffer 116 is shown. The torch 400 is substantially similar or identical to the torch 100 of FIGS. 1-3 except for the inclusion of a remote cap 402. The remote cap 402 comprises a stationary snuffer cap 404 affixed a spaced apart distance from the aperture 109 by a stationary arm 406. The snuffer cap 404 is a planar component, oriented generally perpendicularly to the distal end 203 of the sleeve 200. The snuffer cap 440 may be spaced apart sufficiently from the aperture 109 so as to allow the wick 114 to burn freely when the snuffer 116 is in the retracted position. In some embodiments, the wick 114 may even extend so far as to be in contact with the snuffer cap 404. When the snuffer 116 is in the fully extended position, as shown in FIG. 4, the wick 114 is completely surrounded and encapsulated such that any combustion is snuffed out or starved for oxygen such that it cannot continue.

* * * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A device comprising:

a canister for attaching to a fuel container;

a wick holder passing through the canister for holding a wick in a position to draw fuel from the reservoir for combustion proximate a top cap of the canister;

a snuffer in the canister having a sleeve extendible from a first retracted position to a second extended position, the second extended position extending the sleeve partially beyond the wick holder; and a spring biasing the snuffer sleeve toward the second raised position;

wherein when the canister is upright the snuffer remains in the first lowered position by compression of the biasing spring under a weight of the snuffer and when the canister is tilted beyond a predetermined angle the spring overcomes the weight of the snuffer to move the sleeve to the second extended position;

wherein the top cap has an aperture proximate a distal end of the wick holder sized to allow the snuffer sleeve to extend from the first retracted position to the second extended position by sliding beyond the upper end of the wick holder.

2. The device of claim 1, wherein the snuffer further comprises a flange affixed to a proximal portion of the sleeve, the flange receiving the biasing force of the spring.

3. The device of claim 2, wherein the spring comprises a coil spring pressing upward on the flange at least when the canister is upright.

4. The device of claim 3, wherein the coil spring circumscribes the wick holder.

5. The device of claim 4, further comprising a free weight in the canister and bearing down upon the flange when the canister is upright.

6. The device of claim 5, wherein the free weight comprises a metallic ball that is unrestrained within the canister.

7. The device of claim 1, further comprising a snuffer cap affixed in a stationary relationship with respect to the top cap and placed beyond the distal end of the wick holder such that the snuffer sleeve contacts the snuffer cap in the second extended position to enclose a portion of the wick extending beyond the wick holder.

8. The device of claim 1, further comprising a fitting to affix the canister to a liquid fuel container.

9. The device of claim 8, further wherein the wick holder extends through the fitting.

10. The device of claim 8, wherein the canister, the snuffer sleeve, and the wick holder share a common central axis.

11. A torch comprising:

a wick holder having a combustion end and a fuel reservoir end;

a snuffer sleeve in a sliding engagement with and surrounding the wick holder and having a retracted position and an extended position wherein the snuffer sleeve extends beyond the combustion end of the wick holder; and a biasing member that urges the snuffer sleeve toward the extended position;

wherein, the weight of the snuffer sleeve and the force of the biasing member are such that the snuffer sleeve remains in the retracted position when the torch is upright;

and wherein the snuffer sleeve is free to extend and does extend under force of the biasing member to the extended position when the snuffer sleeve is deviated from a vertical position more than a predetermined amount; and wherein the vertical position is defined by a position of the snuffer sleeve wherein the combustion end is fully superior to the fuel reservoir end.

12. The torch of claim 11, wherein the wick holder passes coaxially through a canister that retains the snuffer sleeve position inside the canister when in the retracted position.

13. The torch of claim 12, wherein the canister has a top cap with a central opening sized to pass the snuffer sleeve but retain within the canister a flange affixed to the sleeve.

14. The torch of claim 13, wherein the biasing member is a coil spring that surrounds the wick holder and engages against the flange to urge the snuffer sleeve toward the extended position.

15. The torch of claim 11, further comprising a stationary snuffer cap spaced apart a fixed distance from the combustion end of the wick holder such that the snuffer sleeve contacts the snuffer cap when the snuffer sleeve is in the extended position.

16. A device comprising:

a canister defining an interior volume between a fuel container fitting and a top cap;

a wick holder passing through the interior volume;

a snuffer sleeve slidingly engaged with the wick holder therein between;

a flange extending from the snuffer sleeve inside the interior volume, the flange being retained within the interior volume by the top cap;

a spring within the interior volume on an opposite side of the flange from the top cap;

wherein the snuffer sleeve has an extended position that places the snuffer sleeve at least partially off the wick holder and out of the interior volume;

wherein the snuffer has a retracted position wherein the flange compresses the spring in the interior volume; and wherein the snuffer is retained by its own weight in the retracted position when the canister is upright and the weight of the snuffer is overcome by the spring alone to move the snuffer to the extended position when the canister is tipped to one side beyond a predetermined amount.

17. The device of claim 16, further comprising a free weight interposing the flange and the top cap.

18. The device of claim 16, wherein the spring is a coil spring circumscribing the wick holder.

19. The device of claim 16, further comprising a snuffer cap affixed to the top cap such that the snuffer sleeve contacts the snuffer cap when in the extended position but not when in the retracted position.

* * * * *